US008276401B2

(12) United States Patent
Higashiyama et al.

(10) Patent No.: US 8,276,401 B2
(45) Date of Patent: Oct. 2, 2012

(54) EVAPORATOR

(75) Inventors: Naohisa Higashiyama, Oyama (JP); Hokuto Mine, Oyama (JP); Motoyuki Takagi, Oyama (JP)

(73) Assignee: Showa Denko K.K., Tokyo (JP)

( * ) Notice: Subject to any disclaimer, the term of this patent is extended or adjusted under 35 U.S.C. 154(b) by 586 days.

(21) Appl. No.: 12/585,478

(22) Filed: Sep. 16, 2009

(65) Prior Publication Data

US 2010/0077794 A1 Apr. 1, 2010

(30) Foreign Application Priority Data

Sep. 29, 2008 (JP) ..... 2008-249648

(51) Int. Cl.
*F25B 39/02* (2006.01)
*F28D 1/02* (2006.01)
*F28F 9/04* (2006.01)

(52) U.S. Cl. ..... 62/515; 165/153; 165/173; 165/178; 62/524; 62/525; 62/526

(58) Field of Classification Search ..... 62/515, 62/524, 525, 526; 165/153, 173, 175, 178; 285/125.1, 126.1, 129.1, 122.1, 124.3, 124.4
See application file for complete search history.

(56) References Cited

U.S. PATENT DOCUMENTS 5,553,664 A * 9/1996 Nishishita et al. ..... 165/153
5,685,366 A * 11/1997 Voss et al. ..... 165/144
5,934,367 A * 8/1999 Shimmura et al. ..... 165/174
5,979,542 A * 11/1999 Inoue et al. ..... 165/133
6,453,990 B2 * 9/2002 Higashiyama et al. ..... 165/178
7,007,750 B2 * 3/2006 Higashiyama ..... 165/178
7,219,717 B2 * 5/2007 Hanafusa ..... 165/153
7,926,853 B2 * 4/2011 Katoh et al. ..... 285/124.2
2005/0279485 A1 * 12/2005 Chiba et al. ..... 165/78
2007/0144715 A1 * 6/2007 Ohashi ..... 165/153
2007/0169512 A1 * 7/2007 Ishizaka et al. ..... 62/515
2009/0293535 A1 * 12/2009 Aung et al. ..... 62/515
2011/0259042 A1 * 10/2011 Nishino et al. ..... 62/527

FOREIGN PATENT DOCUMENTS

JP 2005-164226 A 6/2005

* cited by examiner

*Primary Examiner* — Judy Swann
*Assistant Examiner* — Claire Rojohn, III
(74) *Attorney, Agent, or Firm* — Edwards Wildman Palmer LLP

(57) ABSTRACT

An evaporator includes a refrigerant inlet header section, a refrigerant outlet header section, and a refrigerant circulation path connecting the two header sections. A refrigerant inlet-outlet member composed of a first plate, a second plate, and an intermediate plate is joined to the two header sections. The refrigerant inlet-outlet member has an inflow channel whose one end communicates with the refrigerant inlet of the refrigerant inlet header section and whose other end is opened to a rear edge of the refrigerant inlet-outlet member, and an outflow channel whose one end communicates with the refrigerant outlet of the refrigerant outlet header section and whose other end is opened to the rear edge. The first and second plates each have inflow-channel-forming and outflow-channel-forming outward swelled portions. Cutouts and a through hole are formed in the intermediate plate such that the inflow channel and the outflow channel cross each other.

7 Claims, 8 Drawing Sheets

EVAPORATOR

BACKGROUND OF THE INVENTION

The present invention relates to an evaporator used in a car air conditioner, which is a refrigeration cycle to be mounted on an automobile, for example.

In this specification and appended claims, the downstream side (a direction represented by arrow X in FIG. 1 and the right sides of FIGS. 4 to 6) of an air flow through air-passing clearances between adjacent heat exchange tubes will be referred to as the "front," and the opposite side as the "rear." Further, the upper, lower, left-hand, and right-hand sides as viewed frontward from the rear side (the upper, lower, left-hand, and right-hand sides of FIG. 1) will be referred to as "upper," "lower," "left," and "right," respectively.

The present applicant has proposed an evaporator which satisfies the requirements for reduction in size and weight and higher performance (refer to Japanese Patent Application Laid-Open (kokai) No. 2005-164226). The evaporator includes a refrigerant inlet header section and a refrigerant outlet header section juxtaposed in the front-rear direction, and a refrigerant circulation path for establishing communication between the two header sections. The refrigerant circulation path includes a first intermediate header section disposed to face the refrigerant inlet header section, a second intermediate header section disposed rearward of the first intermediate header section to face the refrigerant outlet header section, a plurality of heat exchange tubes disposed between the refrigerant inlet header section and the first intermediate header section, and a plurality of heat exchange tubes disposed between the refrigerant outlet header section and the second intermediate header section. A refrigerant inlet is formed at one end of the refrigerant inlet header section, and a refrigerant outlet is formed at one end of the refrigerant outlet header section, the one end being located on the same side as the refrigerant inlet. Refrigerant having flowed into the refrigerant inlet header section through the refrigerant inlet passes through the refrigerant circulation path, and reaches the refrigerant outlet header section, from which the refrigerant is fed out through the refrigerant outlet. A pipe joint plate which has a refrigerant inflow portion assuming the form of a short tube and communicating with the refrigerant inlet, and a refrigerant outflow portion assuming the form of a short tube and communicating with the refrigerant outlet is joined to the refrigerant inlet header section and the refrigerant outlet header section to extend over the header sections. An end portion of a refrigerant inlet pipe is inserted into and joined to the refrigerant inflow portion, and a diameter-reduced end portion of a refrigerant outlet pipe which is larger in diameter than the refrigerant inlet pipe is inserted into and joined to the refrigerant outflow portion.

Although not illustrated, in the evaporator disclosed in the publication, the refrigerant inlet pipe and the refrigerant outlet pipe are bent frontward; an expansion valve attachment member is joined to end portions of the two pipes such that the expansion valve attachment member extends over the pipes; and an expansion valve is attached to the expansion valve attachment member. The opening of the expansion valve is adjusted on the basis of the temperature and pressure of the refrigerant which flows through the refrigerant outlet pipe after having flowed out of the interior of the refrigerant outlet header section.

However, in the evaporator disclosed in the publication, since the refrigerant inlet pipe and the refrigerant outlet pipe are bent through bending work, there is a limit on reducing the radius of curvature of the refrigerant inlet pipe and the refrigerant outlet pipe. Therefore, the evaporator has a problem in that the expansion valve cannot be disposed near the evaporator.

SUMMARY OF THE INVENTION

An object of the present invention is to solve the above problem and to provide an evaporator which enables an expansion valve to be disposed closer to the evaporator, as compared with the case of the evaporator disclosed in the publication.

To fulfill the above object, the present invention comprises the following modes.

1) An evaporator comprising a refrigerant inlet header section and a refrigerant outlet header section juxtaposed in a front-rear direction, and a refrigerant circulation path for establishing communication between the two header sections, wherein a refrigerant inlet is formed at one end of the refrigerant inlet header section, and a refrigerant outlet is formed at one end of the refrigerant outlet header section, the one end being located on the same side as the refrigerant inlet; and refrigerant having flowed into the refrigerant inlet header section through the refrigerant inlet passes through the refrigerant circulation path, and reaches the refrigerant outlet header section, from which the refrigerant is fed out through the refrigerant outlet, wherein a refrigerant inlet-outlet member formed by stacking and joining a first plate, a second plate, and an intermediate plate located between the first plate and the second plate is joined to the refrigerant inlet header section and the refrigerant outlet header section such that the refrigerant inlet-outlet member extends over the refrigerant inlet header section and the refrigerant outlet header section;

the refrigerant inlet-outlet member has an inflow channel and an outflow channel provided such that the inflow channel and the outflow channel cross each other as viewed from a side, one end of the inflow channel communicating with the refrigerant inlet of the refrigerant inlet header section, the other end of the inflow channel being opened to a rear edge of the refrigerant inlet-outlet member, one end of the outflow channel communicating with the refrigerant outlet of the refrigerant outlet header section, and the other end of the outflow channel being opened to the rear edge of the refrigerant inlet-outlet member; and at least one of the first and second plates has an inflow-channel-forming outward swelled portion, and the other of the first and second plates has an outflow-channel-forming outward swelled portion.

2) An evaporator according to par. 1), wherein the inflow-channel-forming outward swelled portion and the outflow-channel-forming outward swelled portion are formed on each of the first and second plates of the refrigerant inlet-outlet member; and, in order to enable the inflow channel and the outflow channel to cross each other as viewed from the side, cutouts and a through hole are formed in the intermediate plate such that communication is established between the inflow-channel-forming outward swelled portions of the first and second plates and communication is established between the outflow-channel-forming outward swelled portions of the first and second plates.

3) An evaporator according to par. 1), wherein the first plate of the refrigerant inlet-outlet member has a first communication opening communicating with the refrigerant inlet of the refrigerant inlet header section, a second communication opening communicating with the refrigerant outlet of the refrigerant outlet header section, a first inflow-channel-forming outwardly swelled portion whose one end is located at a position separated from the first and second communication openings and whose other end is opened to the rear edge of the first plate, and a first outflow-channel-forming outwardly swelled portion whose one end is located at a position separated from the first and second communication openings and whose other end is opened to the rear edge of the first plate; the second plate has a second inflow-channel-forming outwardly swelled portion whose one end is located at a position separated from the first and second communication openings of the first plate and whose other end is opened to the rear edge of the second plate at the same position as the other end of the first inflow-channel-forming outwardly swelled portion of the first plate, a third inflow-channel-forming outwardly swelled portion whose one end is located at a position corresponding to the first communication opening of the first plate and whose other end is located at a position separated from the second communication opening of the first plate and the second inflow-channel-forming outwardly swelled portion, and a second outflow-channel-forming outwardly swelled portion whose one end is located at a position corresponding to the second communication opening of the first plate and whose other end is opened to the rear edge of the second plate at the same position as the first outflow-channel-forming outwardly swelled portion of the first plate; and the intermediate plate has a first cutout whose one end is opened to the rear edge of the intermediate plate at the same position as the first inflow-channel-forming outwardly swelled portion of the first plate and which establishes communication between the interior of the first inflow-channel-forming outwardly swelled portion of the first plate and the interior of the second inflow-channel-forming outwardly swelled portion of the second plate, a first through hole which establishes communication between the interior of the first inflow-channel-forming outwardly swelled portion of the first plate and the interior of the third inflow-channel-forming outwardly swelled portion of the second plate, a second through hole which establishes communication between the first communication opening of the first plate and the interior of the third inflow-channel-forming outwardly swelled portion of the second plate, a second cutout whose one end is opened to the rear edge of the intermediate plate at the same position as the first outflow-channel-forming outwardly swelled portion of the first plate and which establishes communication between the interior of the first outflow-channel-forming outwardly swelled portion of the first plate and the interior of the second outflow-channel-forming outwardly swelled portion of the second plate, and a third through hole which establishes communication between the second communication opening of the first plate and the interior of the second outflow-channel-forming outwardly swelled portion of the second plate.

4) An evaporator according to par. 3), wherein a portion of the intermediate plate between the first through hole and the second through hole is cut and removed so as to form a removed region so that the first through hole and the second through hole communicate with each other via the removed region, whereby the first through hole and the second through hole are unified with each other.

5) An evaporator according to par. 1), wherein the first plate has a third outflow-channel-forming outwardly swelled portion formed independently of the first communication opening, the first inflow-channel-forming outwardly swelled portion, and the first outflow-channel-forming outwardly swelled portion; and the intermediate plate has a fourth through hole which establishes communication between the interior of the third outflow-channel-forming outwardly swelled portion and the interior of the second outflow-channel-forming outwardly swelled portion of the second plate.

6) An evaporator according to par. 5), wherein a portion of the intermediate plate between the third through hole and the fourth through hole is cut and removed so as to form a removed region so that the third through hole and the fourth through hole communicate with each other via the removed region, whereby the third through hole and the fourth through hole are unified with each other.

7) An evaporator according to par. 1), wherein the rear-edge-side opening of the outflow channel of the refrigerant inlet-outlet member is located above the rear-edge-side opening of the inflow channel of the refrigerant inlet-outlet member.

According to the evaporators of pars. 1) to 7), an expansion valve attachment member having a high-pressure-refrigerant flow channel to communicate with the inflow channel and a low-pressure-refrigerant flow channel to communicate with the outflow channel can be joined directly to the rear edge portion of the refrigerant inlet-outlet member, and an expansion valve can be attached to the expansion valve attachment member. In addition, unlike the above-described evaporator disclosed in the publication, bent pipes are not required to use. Therefore, as compared with the evaporator disclosed in the publication, the expansion valve can be disposed near the evaporator.

According to the evaporator of par. 5), it is possible to reduce pressure loss in the outflow channel of the refrigerant inlet-outlet member through which gas-phase refrigerant of low temperature and low pressure flows.

DESCRIPTION OF THE PREFERRED EMBODIMENTS

Preferred embodiments of the present invention will next be described with reference to the drawings.

In the following description, the term "aluminum" encompasses aluminum alloys in addition to pure aluminum.

Figure 1:
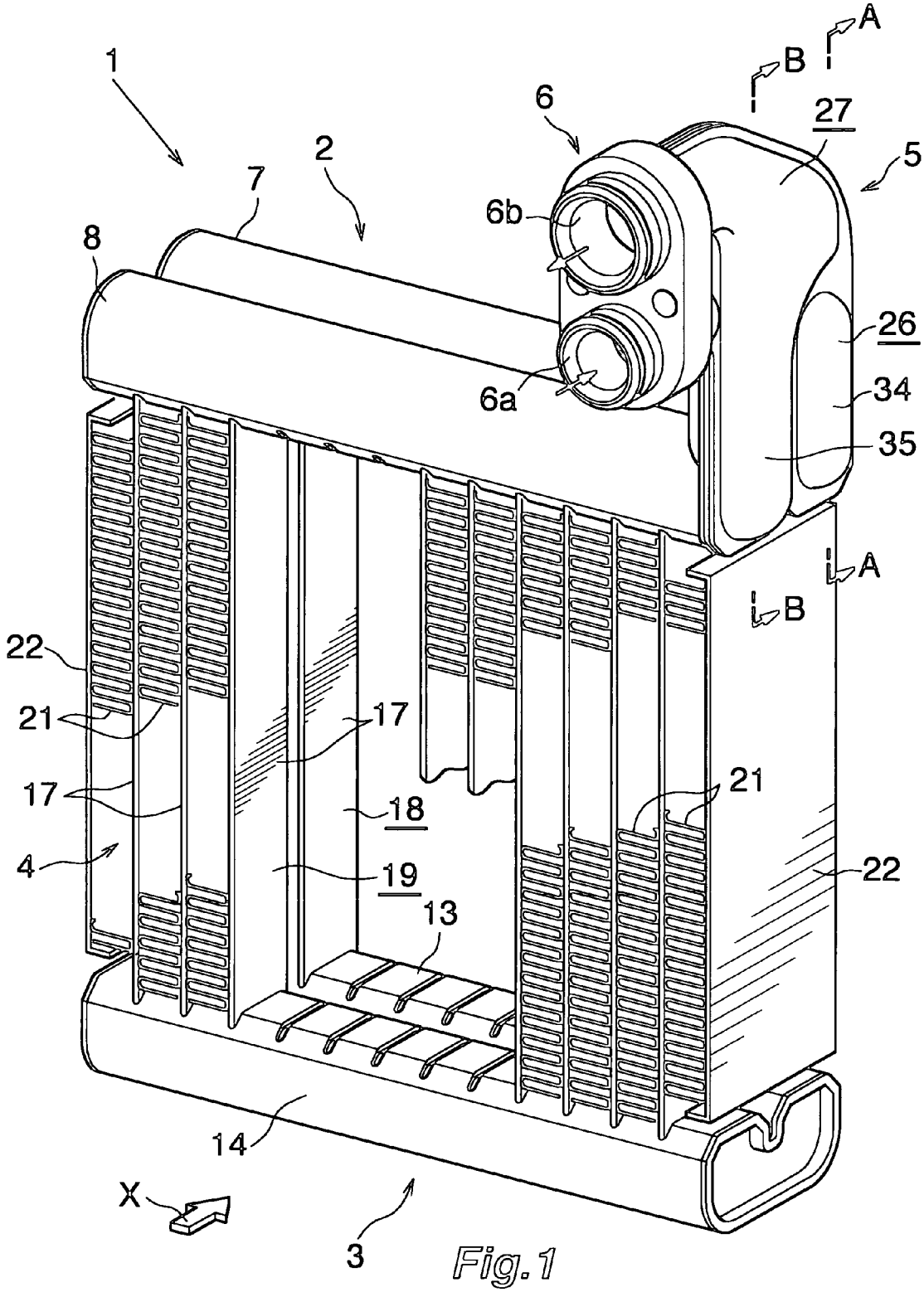
FIG. 1 is a partially cut-away perspective view showing the overall structure of an evaporator according to a first embodiment of the present invention.
Figure 3:
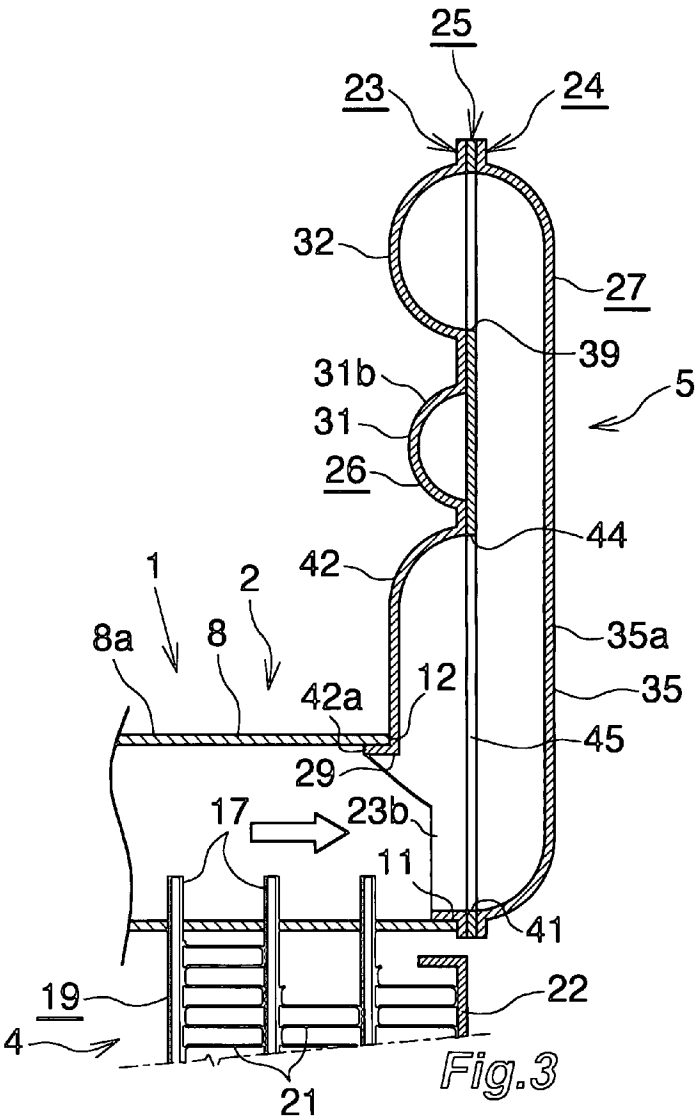
FIG. 3 is an enlarged cross sectional view taken along line B-B of FIG. 1.
Figure 2:
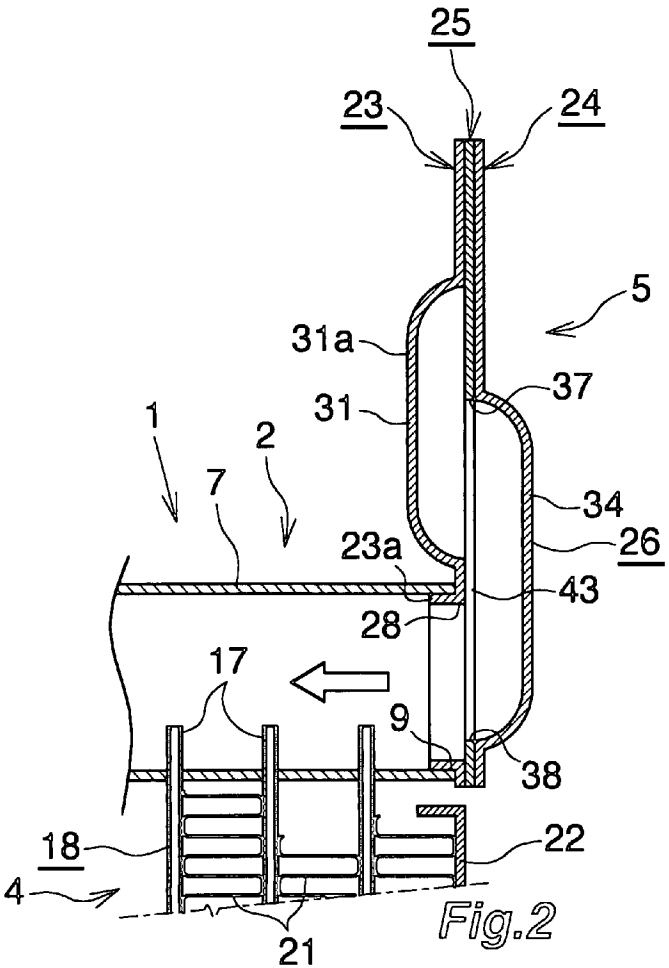
FIG. 2 is an enlarged cross sectional view taken along line A-A of FIG. 1.
Figure 4:
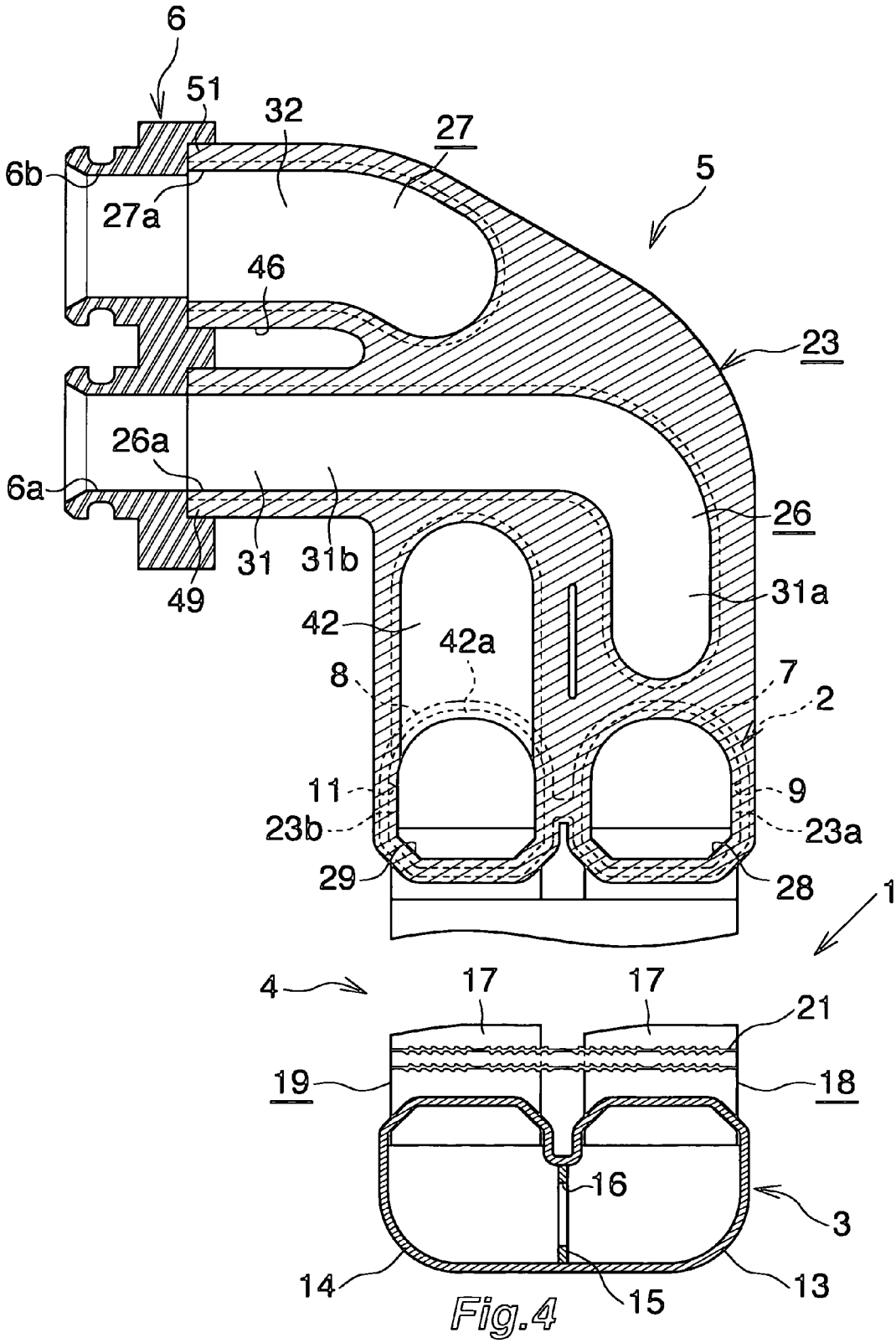
FIG. 4 is a vertical cross sectional view taken along a plane passing through a first plate of a refrigerant inlet-outlet member, as viewed from the right side.
Figure 5:
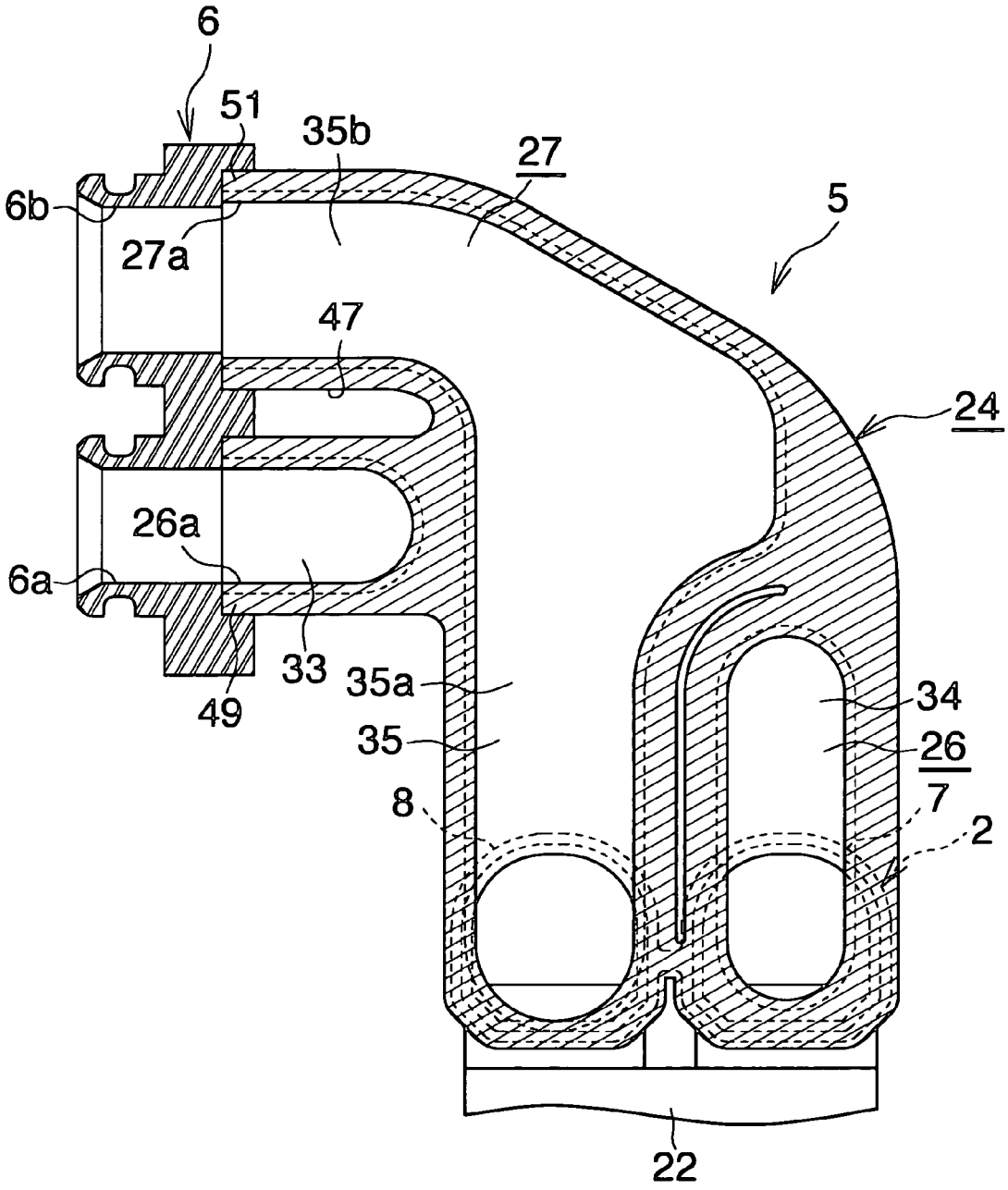
FIG. 5 is a vertical cross sectional view taken along a plane passing through a second plate of the refrigerant inlet-outlet member, as viewed from the right side.
Figure 6:
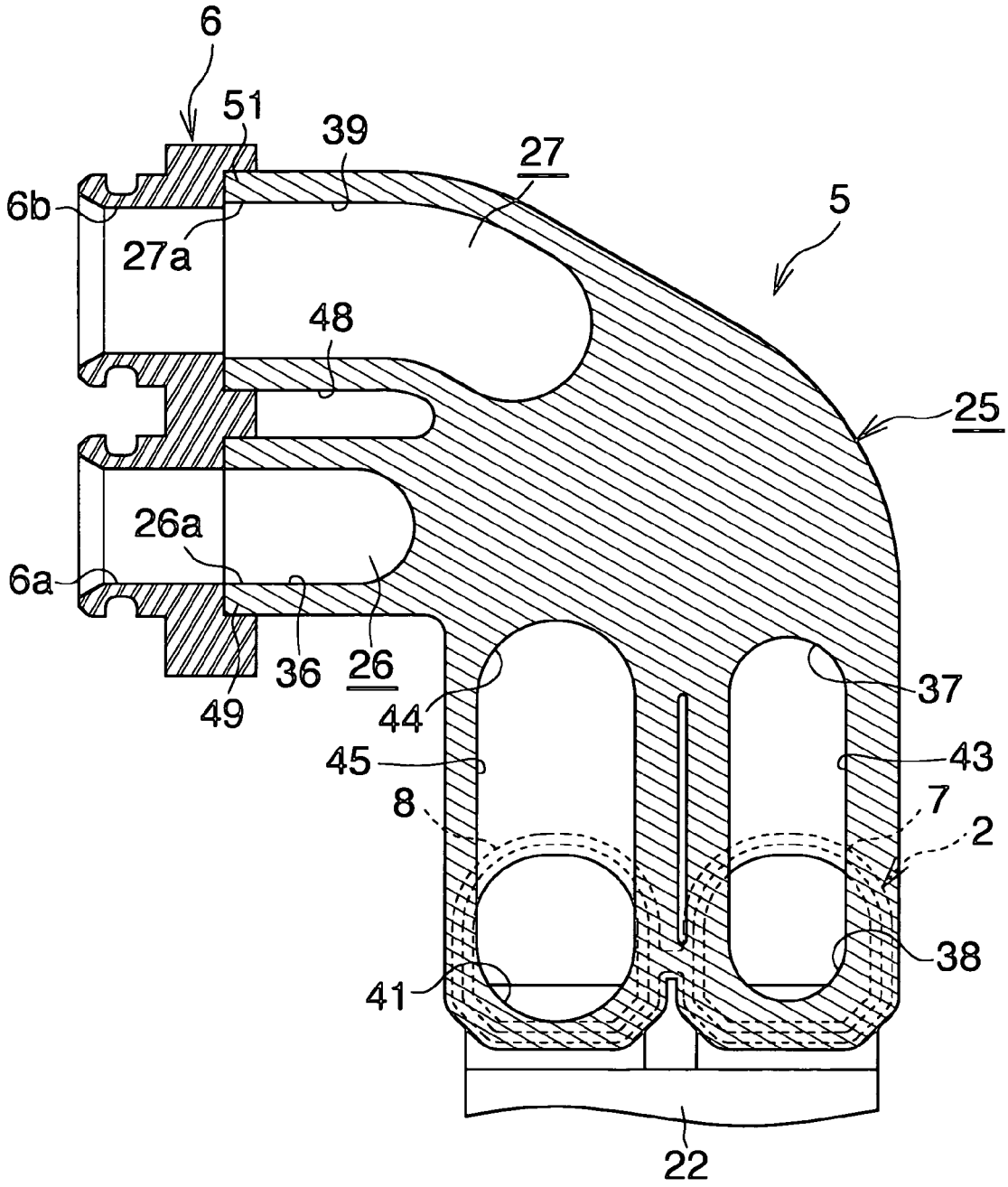
FIG. 6 is a vertical cross sectional view taken along a plane passing through an intermediate plate of the refrigerant inlet-outlet member, as viewed from the right side.
Figure 7:
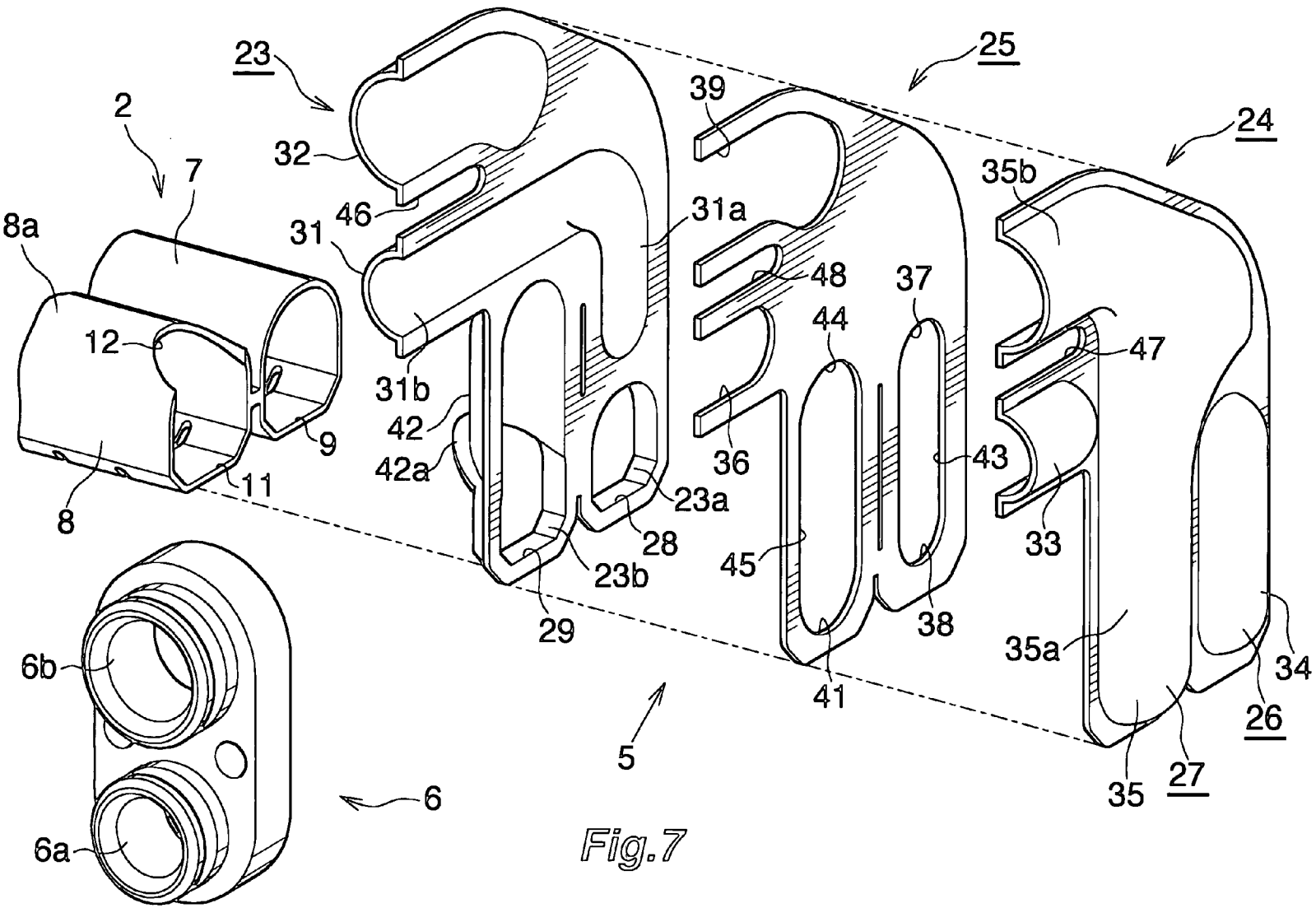
FIG. 7 is a partial enlarged and exploded perspective view of the refrigerant inlet-outlet member of the evaporator of FIG. 1.

FIGS. 1 to 7 show a first embodiment. FIG. 1 shows the overall configuration of an evaporator, and FIGS. 2 to 7 show the configurations of essential portions of the evaporator.

As shown in FIGS. 1 to 4, an evaporator 1 to be used in a car air conditioner in which fluorocarbon refrigerant is used includes a first header tank 2 and a second header tank 3, which are formed of aluminum and are disposed apart from each other in the vertical direction; a heat exchange core section 4 provided between the first and second header tanks 2 and 3; a refrigerant inlet-outlet member 5 joined to a right end portion of the first header tank 2; and an expansion valve attachment member 6 joined to the refrigerant inlet-outlet member 5.

The first header tank 2 includes a refrigerant inlet header section 7 located on the front side (downstream side with respect to the air flow direction), and a refrigerant outlet header section 8 located on the rear side (upstream side with respect to the air flow direction) and integrated with the refrigerant inlet header section 7. A refrigerant inlet 9 is provided in a right end portion of the refrigerant inlet header section 7, and a refrigerant outlet 11 is provided in a right end portion of the refrigerant outlet header section 8. A cutout 12, which has an approximately U-like shape as viewed from above, is formed in a right end portion of a top wall 8*a* of the outlet header section 8 (see FIG. 7). The second header tank 3 includes a first intermediate header section 13 located on the front side, and a second intermediate header section 14 located on the rear side and integrated with the first intermediate header section 13. The first intermediate header section 13 and the second intermediate header section 14 are formed by partitioning the interior of the second header tank 3 into front and rear spaces by means of a partition member 15. A plurality of communication openings 16 formed in the partition member 15 at predetermined intervals in the left-right direction establish communication between the interior of the first intermediate header section 13 and the interior of the second intermediate header section 14.

The heat exchange core section 4 is configured as follows. Heat exchange tube rows 18 and 19 are arranged in a plurality of; herein, two, rows in the front-rear direction. Each of the heat exchange tube rows 18 and 19 is composed of a plurality of flat heat exchange tubes 17, which are made of aluminum and are arranged at predetermined intervals in the left-right direction such that their width direction coincides with the front-rear direction. Corrugated fins 21 made of aluminum are disposed within corresponding air-passing clearances between the adjacent heat exchange tubes 17 of the heat exchange tube rows 18 and 19 and externally of the left-end and right-end heat exchange tubes 17 of the heat exchange tube rows 18 and 19 in such a manner that the corrugated fins 21 extend over both the exchange tubes 17 of the front heat exchange tube row 18 and those of the rear heat exchange tube row 19. The corrugated fins 21 are brazed to the exchange tubes 17 of the heat exchange tube rows 18 and 19. Side plates 22 made of aluminum are disposed externally of the left-end and right-end corrugated fins 21 and are brazed to the corresponding corrugated fins 21.

The heat exchange tubes 17 of the front heat exchange tube row 18 are disposed between the refrigerant inlet header section 7 of the first header tank 2 and the first intermediate header section 13 of the second header tank 3; and upper and lower end portions of the heat exchange tubes 17 of the front heat exchange tube row 18 are connected to the refrigerant inlet header section 7 and the first intermediate header section 13, respectively. The heat exchange tubes 17 of the rear heat exchange tube row 19 are disposed between the refrigerant outlet header section 8 of the first header tank 2 and the second intermediate header section 14 of the second header tank 3; and upper and lower end portions of the heat exchange tubes 17 of the rear heat exchange tube row 19 are connected to the refrigerant outlet header section 8 and the second intermediate header section 14, respectively. The heat exchange tubes 17 of the front and rear heat exchange tube rows 18 and 19 and the first and second intermediate header sections 13 and 14 form a refrigerant circulation path which establishes communication between the refrigerant inlet header section 7 and the refrigerant outlet header section 8.

As shown in FIGS. 2 to 7, the refrigerant inlet-outlet member 5 is formed by means of stacking and joining together a vertical first aluminum plate 23 located on the left side (the side toward the first header tank 2), a vertical second aluminum plate 24 located on the right side, and a vertical intermediate aluminum plate 25 located between the first plate 23 and the second plate 24. The refrigerant inlet-outlet member 5 extends over and is joined to the right end portions of the refrigerant inlet header section 7 and the refrigerant outlet header section 8 of the first header tank 2. An inflow channel 26 and an outflow channel 27 are provided in the refrigerant inlet-outlet member 5. One end of the inflow channel 26 communicates with the refrigerant inlet 9 of the refrigerant inlet header section 7, and the other end of the inflow channel 26 is opened to the rear edge of the refrigerant inlet-outlet member 5. One end of the outflow channel 27 communicates with the refrigerant outlet 11 of the refrigerant outlet header section 8, and the other end of the outflow channel 27 is opened to the rear edge of the refrigerant inlet-outlet member 5. The opening of the inflow channel 26 at the rear edge of the refrigerant inlet-outlet member 5 will be referred to as an inlet 26*a*, and the opening of the outflow channel 27 at the rear edge of the refrigerant inlet-outlet member 5 will be referred to as an outlet 27*a*.

The first plate 23 of the refrigerant inlet-outlet member 5 has a first communication opening 28, a second communication opening 29, a first inflow-channel-forming outwardly swelled portion 31, and a first outflow-channel-forming outwardly swelled portion 32. The first communication opening 28 communicates with the refrigerant inlet 9 of the refrigerant inlet header section 7. The second communication opening 29 communicates with the refrigerant outlet 11 of the refrigerant outlet header section 8. The first inflow-channel-forming outwardly swelled portion 31 is formed such that its one end is located at a position separated from the first and second communication openings 28 and 29, and its other end is opened to the rear edge of the first plate 23. The first outflow-channel-forming outwardly swelled portion 32 is formed such that its one end is located at a position separated from the first and second communication openings 28 and 29, and its other end is opened to the rear edge of the first plate 23 at a position above that of the opening of the first inflow-channel-forming outwardly swelled portion 31.

The second plate 24 of the refrigerant inlet-outlet member 5 has a second inflow-channel-forming outwardly swelled portion 33, a third inflow-channel-forming outwardly swelled portion 34, and a second outflow-channel-forming outwardly swelled portion 35. The second inflow-channel-forming outwardly swelled portion 33 is formed such that its one end is located at a position separated from the first and second communication openings 28 and 29 of the first plate 23, and its other end is opened to the rear edge of the second plate 24 at the same height as the other end of the first inflow-channel-forming outwardly swelled portion 31 of the first plate 23. The third inflow-channel-forming outwardly swelled portion 34 is formed such that its one end is located at a position corresponding to the first communication opening 28 of the first plate 23, and its other end is located at a position separated from the second communication opening 29 of the first plate 23 and the second inflow-channel-forming outwardly swelled portion 33. The second outflow-channel-forming outwardly swelled portion 35 is formed such that its one end is located at a position corresponding to the second communication opening 29 of the first plate 23, and its other end is opened to the rear edge of the second plate 24 at the same position as the first outflow-channel-forming outwardly swelled portion 32 of the first plate 23.

The intermediate plate 25 of the refrigerant inlet-outlet member 5 has a first cutout 36, a first through hole 37, a second through hole 38, a second cutout 39, and a third through hole 41. The first cutout 36 is formed such that its one end is opened to the rear edge of the intermediate plate 25 at the same position as the first inflow-channel-forming outwardly swelled portion 31 of the first plate 23, and communication is established between the interior of the first inflow-channel-forming outwardly swelled portion 31 of the first plate 23 and the interior of the second inflow-channel-forming outwardly swelled portion 33 of the second plate 24. The first through hole 37 establishes communication between the interior of the first inflow-channel-forming outwardly swelled portion 31 of the first plate 23 and the interior of the third inflow-channel-forming outwardly swelled portion 34 of the second plate 24. The second through hole 38 establishes communication between the first communication opening 28 of the first plate 23 and the interior of the third inflow-channel-forming outwardly swelled portion 34 of the second plate 24. The second cutout 39 is formed such that its one end is opened to the rear edge of the intermediate plate 25 at the same position as the first outflow-channel-forming outwardly swelled portion 32 of the first plate 23, and communication is established between the interior of the first outflow-channel-forming outwardly swelled portion 32 of the first plate 23 and the interior of the second outflow-channel-forming outwardly swelled portion 35 of the second plate 24. The third through hole 41 establishes communication between the second communication opening 29 of the first plate 23 and the interior of the second outflow-channel-forming outwardly swelled portion 35 of the second plate 24.

A leftward projecting portion 23*a* is integrally formed around the first communication opening 28 of the first plate 23 such that the leftward projecting portion 23*a* extends along the entire circumference of the first communication opening 28. The leftward projecting portion 23*a* is inserted into the refrigerant inlet header section 7 of the first header tank 2 through the refrigerant inlet 9. A leftward projecting portion 23*b* is integrally formed around the second communication opening 29 of the first plate 23 such that the leftward projecting portion 23*b* extends along the circumference of the second communication opening 29, except for an upper end portion thereof. The leftward projecting portion 23*b* is inserted into the refrigerant outlet header section 8 of the first header tank 2 through the refrigerant outlet 11. The first inflow-channel-forming outwardly swelled portion 31 of the first plate 23 is composed of a vertical portion 31*a* which extends upward from a position slightly above the first communication opening 28, and a horizontal portion 31*b* which connects to the upper end of the vertical portion 31*a* via an arcuate portion, extends rearward, and reaches the rear edge of the first plate 23. The first outflow-channel-forming outwardly swelled portion 32 of the first plate 23 is located above the horizontal portion 31*b* of the first inflow-channel-forming outwardly swelled portion 31 and extends horizontally and frontward from a position along the rear edge of the first plate 23 located above the first inflow-channel-forming outwardly swelled portion 31. A front end portion of the first outflow-channel-forming outwardly swelled portion 32 inclines downward toward the front. The front end portion of the first outflow-channel-forming outwardly swelled portion 32 is located at a position corresponding to a central portion, with respect to the front-rear direction, of the horizontal portion 31*b* of the first inflow-channel-forming outwardly swelled portion 31. Further, the first plate 23 has a vertical third outflow-channel-forming outwardly swelled portion 42 which extends upward from the second communication opening 29. The upper end of the third outflow-channel-forming outwardly swelled portion 42 is located at a position slightly lower than the horizontal portion 31*b* of the first inflow-channel-forming outwardly swelled portion 31. The lower edge of the third outflow-channel-forming outwardly swelled portion 42 has a shape which fits the shape of the cutout 12 of the refrigerant outlet header section 8 of the first header tank 2. Further, a leftward projecting portion 42*a* is integrally formed along the outer circumferential surface of the lower end of the third outflow-channel-forming outwardly swelled portion 42. The leftward projecting portion 42*a* is continuous with the leftward projecting portion 23*b* around the second communication opening 29 of the first plate 23, and is inserted into the refrigerant outlet header section 8 through the cutout 12.

The second inflow-channel-forming outwardly swelled portion 33 of the second plate 24 is located at the same height as the horizontal portion 31*b* of the first inflow-channel-forming outwardly swelled portion 31 of the first plate 23 and extends horizontally and frontward from the rear edge of the second plate 24. A front end portion of the second inflow-channel-forming outwardly swelled portion 33 is located slightly rearward of the second outflow-channel-forming outwardly swelled portion 35. The third inflow-channel-forming outwardly swelled portion 34 of the second plate 24 vertically extends upward from a position corresponding to the first communication opening 28 of the first plate 23. An upper end portion of the third inflow-channel-forming outwardly swelled portion 34 is located above the lower end of the vertical portion 31*a* of the first inflow-channel-forming outwardly swelled portion 31 of the first plate 23. The second outflow-channel-forming outwardly swelled portion 35 of the second plate 24 is composed of a vertical portion 35*a* which extends upward from a position corresponding to the second communication opening 29 of the first plate 23 and reaches a position above the second inflow-channel-forming outwardly swelled portion 33, and a horizontal portion 35*b* which extends rearward from the upper end of the vertical portion 35*a* and reaches the rear edge of the first plate 23. A front edge portion of an upper portion of the vertical portion 35*a* is expanded frontward in order to increase the area of the flow channel. An upper edge portion of a front-end-side portion of the horizontal portion 35*b* slants downward toward the front in order to match an upper edge portion of a front-end-side portion of the first outflow-channel-forming outwardly swelled portion 32 of the first plate 23.

The first cutout 36 of the intermediate plate 25 extends horizontally and frontward from the rear edge of the intermediate plate 25. A front end portion of the first cutout 36 is located at the same position as the front end portion of the second inflow-channel-forming outwardly swelled portion 33 of the second plate 24. The shape of the first cutout 36 matches the shape of the second inflow-channel-forming outwardly swelled portion 33 as viewed from the side. As viewed from the side, the first through hole 37 of the intermediate plate 25 overlaps a lower end portion of the vertical portion 31*a* of the first inflow-channel-forming outwardly swelled portion 31 of the first plate 23 and an upper end portion of the third inflow-channel-forming outwardly swelled portion 34 of the second plate 24. The second through hole 38 of the intermediate plate 25 is located at a position corresponding to the first communication opening 28 of the first plate 23. A portion of the intermediate plate 25 between the first through hole 37 and the second through hole 38 is cut and removed so as to form a removed region 43, which establishes communication between the through holes 37 and 38, whereby the second through hole 38 is unified with the first through hole 37. The first through hole 37, the second through hole 38, and the removed region 43 cooperatively form a shape which matches the shape of the third inflow-channel-forming outwardly swelled portion 34 of the second plate 24 as viewed from the right side. The second cutout 39 of the intermediate plate 25 is located at the same height as a rear end portion of the first outflow-channel-forming outwardly swelled portion 32 of the first plate 23, and extends horizontally and frontward from the rear edge. A front end portion of the second cutout 39 slants downward toward the front, so that the front end portion of the second cutout 39 is located at the same position as that of the first outflow-channel-forming outwardly swelled portion 32. The shape of the second cutout 39 matches the shape of the first outflow-channel-forming outwardly swelled portion 32 as viewed from the side. The third through hole 41 of the intermediate plate 25 is located at a position corresponding to the second communication opening 29 of the first plate 23. Further, the intermediate plate 25 has a fourth through hole 44 which establish communication between the interior of an upper end portion of the third outflow-channel-forming outwardly swelled portion 42 of the first plate 23 and an intermediate portion, with respect to the vertical direction, of the vertical portion 35*a* of the second outflow-channel-forming outwardly swelled portion 35 of the second plate 24. A portion of the intermediate plate 25 between the third through hole 41 and the fourth through hole 44 is cut and removed so as to form a removed region 45, which establishes communication between the through holes 41 and 44, whereby the fourth through hole 44 is unified with the third through hole 41.

A portion of the first plate 23 between the horizontal portion 31*b* of the first inflow-channel-forming outwardly swelled portion 31 and the first outflow-channel-forming outwardly swelled portion 32, a portion of the second plate 24 between the second inflow-channel-forming outwardly swelled portion 33 and the horizontal portion 35*b* of the second outflow-channel-forming outwardly swelled portion 35, and a portion of the intermediate plate 25 between the first cutout 36 and the second cutout 39 have respective cutouts 46, 47, and 48, which extend frontward from the rear edges of the first plate 23, the second plate 27, and the intermediate plate 25, respectively. As a result of formation of the cutouts 46, 47, and 48, the refrigerant inlet-outlet member 5 has insertion portions 49 and 51, which are inserted into a high-pressure-refrigerant flow channel 6*a* and a low-pressure-refrigerant flow channel 6*b* of the expansion valve attachment member 6.

The first communication opening 28 and the first inflow-channel-forming outwardly swelled portion 31 of the first plate 23, the second inflow-channel-forming outwardly swelled portion 33 and the third inflow-channel-forming outwardly swelled portion 34 of the second plate 24, and the first cutout 36, the first through hole 37, the second through hole 38, and the removed region 43 of the intermediate plate 25 form the inflow channel 26 within the refrigerant inlet-outlet member 5. The second communication opening 29, the first outflow-channel-forming outwardly swelled portion 32, and the third outflow-channel-forming outwardly swelled portion 42 of the first plate 23, the second outflow-channel-forming outwardly swelled portion 35 of the second plate 24, and the second cutout 39, the third through hole 41, the fourth through hole 44, and the removed region 45 of the intermediate plate 25 form the outflow channel 27 within the refrigerant inlet-outlet member 5. Thus, the inflow channel 26 and the outflow channel 27 cross each other such that their interiors do not communicate with each other.

The refrigerant inlet-outlet member 5 is brazed to the first header tank 2 in a state where the leftward projecting portion 23*a* of the first plate 23 formed around the first communication opening 28 is inserted into the refrigerant inlet header section 7 through the refrigerant inlet 9, the leftward projecting portion 23*b* of the first plate 23 formed around the second communication opening 29 is inserted into the refrigerant outlet header section 8 through the refrigerant outlet 11, and the leftward projecting portion 42*a* at the lower end edge of the third outflow-channel-forming outwardly swelled portion 42 of the first plate 23 is inserted into the refrigerant outlet header section 8 through the cutout 12. Further, the expansion valve attachment member 6 is joined to the refrigerant inlet-outlet member 5 in a state where the insertion portions 49 and 51 of the refrigerant inlet-outlet member 5 are inserted into the respective end portions of the high-pressure-refrigerant flow channel 6*a* and the low-pressure-refrigerant flow channel 6*b* of the expansion valve attachment member 6.

The evaporator 1 having the above-described configuration constitutes a refrigeration cycle in which fluorocarbon refrigerant is used in cooperation with a compressor, a condenser (serving as a refrigerant cooler), and an expansion valve, and the refrigeration cycle is mounted, as a car air conditioner, on a vehicle such as an automobile. At that time, the expansion valve (not shown) is attached to the expansion valve attachment member 6 such that a low-pressure-refrigerant discharge channel is located on the upper side, and a high-pressure-refrigerant supply channel is located on the lower side. At the time of cooling/heating operation, a two-phase refrigerant having passed through the compressor, the condenser, and the high-pressure-refrigerant supply channel of the expansion valve passes through the high-pressure-refrigerant flow channel 6*a* of the expansion valve attachment member 6, and enters the inflow channel 26 via the inlet 26*a* at the rear edge of the refrigerant inlet-outlet member 5. The refrigerant then flows through the inflow channel 26, and flows from the first communication opening 28 into the refrigerant inlet header section 7 via the refrigerant inlet 9 of the first header tank 2. The refrigerant having flowed into the refrigerant inlet header section 7 dividedly flows into the heat exchange tubes 17 of the front heat exchange tube row 18. The refrigerant having entered the heat exchange tubes 17 of the front heat exchange tube row 18 flows downward through the heat exchange tubes 17, and then enters the first intermediate header section 13 of the second header tank 3. The refrigerant having entered the first intermediate header section 13 enters the second intermediate header section 14 through the communication openings 16. The refrigerant having entered the second intermediate header section 14 dividedly flows into the heat exchange tubes 17 of the rear heat exchange tube row 19. The refrigerant having entered the heat exchange tubes 17 of the rear heat exchange tube row 19 flows upward through the heat exchange tubes 17, and then enters the refrigerant outlet header section 8 of the first header tank 2. The refrigerant having entered the refrigerant outlet header section 8 flows rightward through the refrigerant outlet header section 8, passes through the refrigerant outlet 11 of the first header tank 2, and enters the outflow channel 27 of the refrigerant inlet-outlet member 5 via the second communication opening 29. The refrigerant having entered the outflow channel 27 flows through the outflow channel 27, and flows out of the outlet 27*a* at the rear edge of the refrigerant inlet-outlet member 5. The refrigerant then flows through the low-pressure-refrigerant flow channel 6*b* of the expansion valve attachment member 6, and enters the low-pressure-refrigerant discharge channel of the expansion valve. The refrigerant then passes through the low-pressure-refrigerant discharge channel, and is supplied to the compressor.

While the refrigerant flows through the heat exchange tubes 17, the refrigerant exchanges heat with air (see arrow X in FIG. 1) passing through the air-passing clearances between the adjacent heat exchange tubes 17. The refrigerant flows out of the heat exchange tubes 17 in a gaseous phase.

Figure 9:
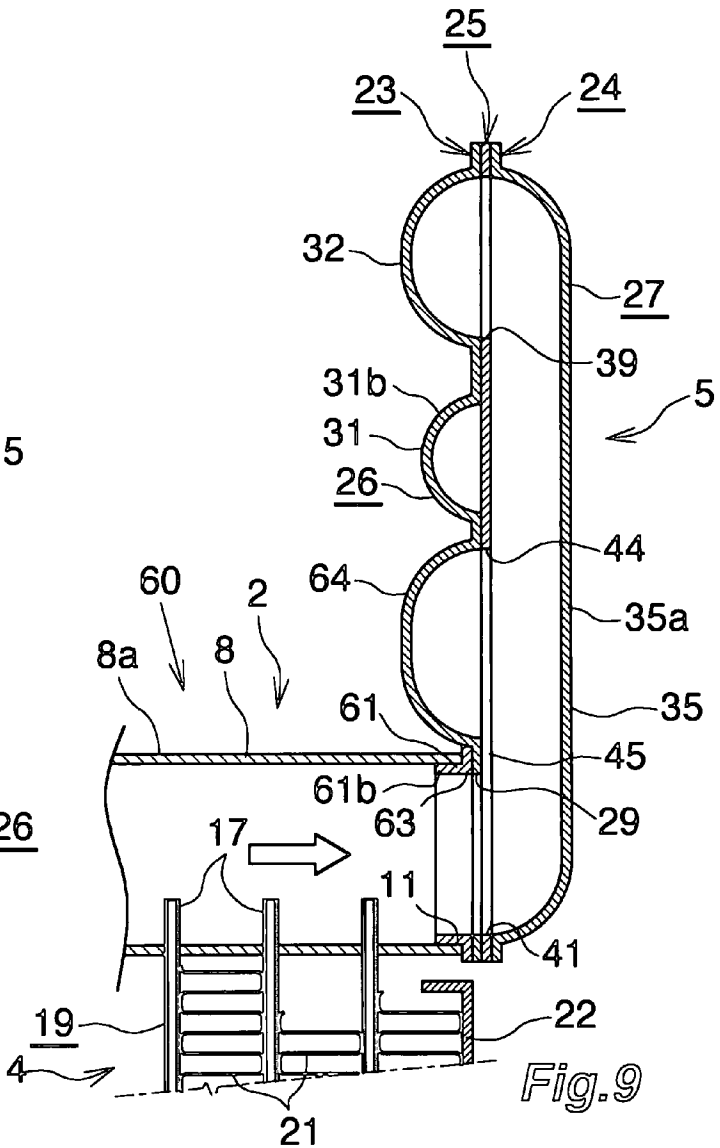
FIG. 9 is a view corresponding to FIG. 3 and showing the evaporator according to the second embodiment of the present invention.
Figure 8:
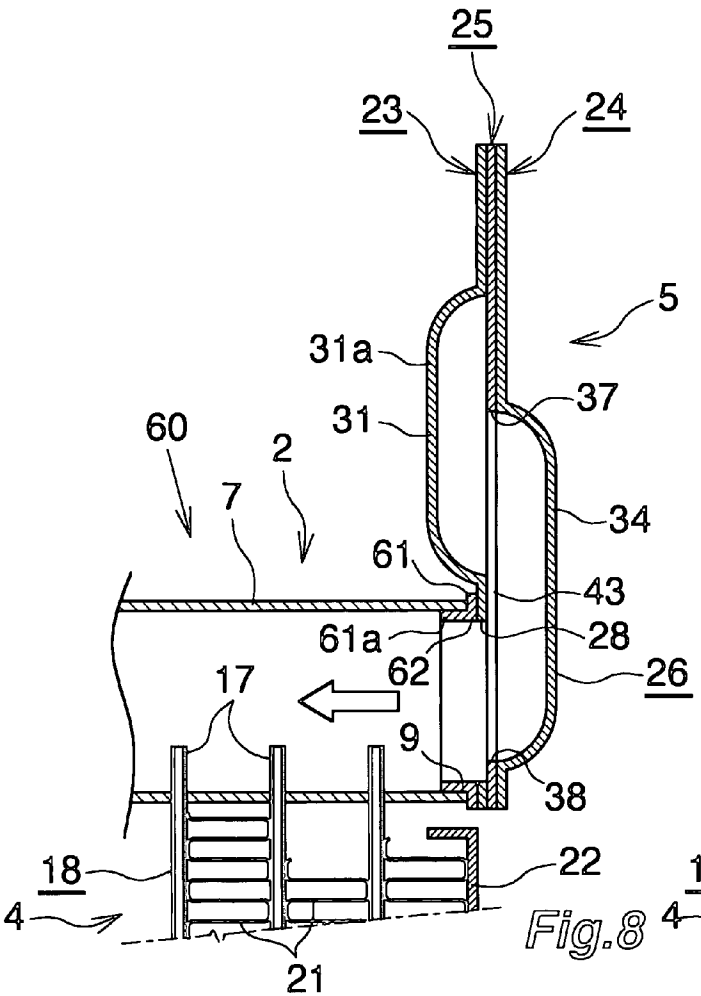
FIG. 8 is a view corresponding to FIG. 2 and showing an evaporator according to a second embodiment of the present invention.
Figure 10:
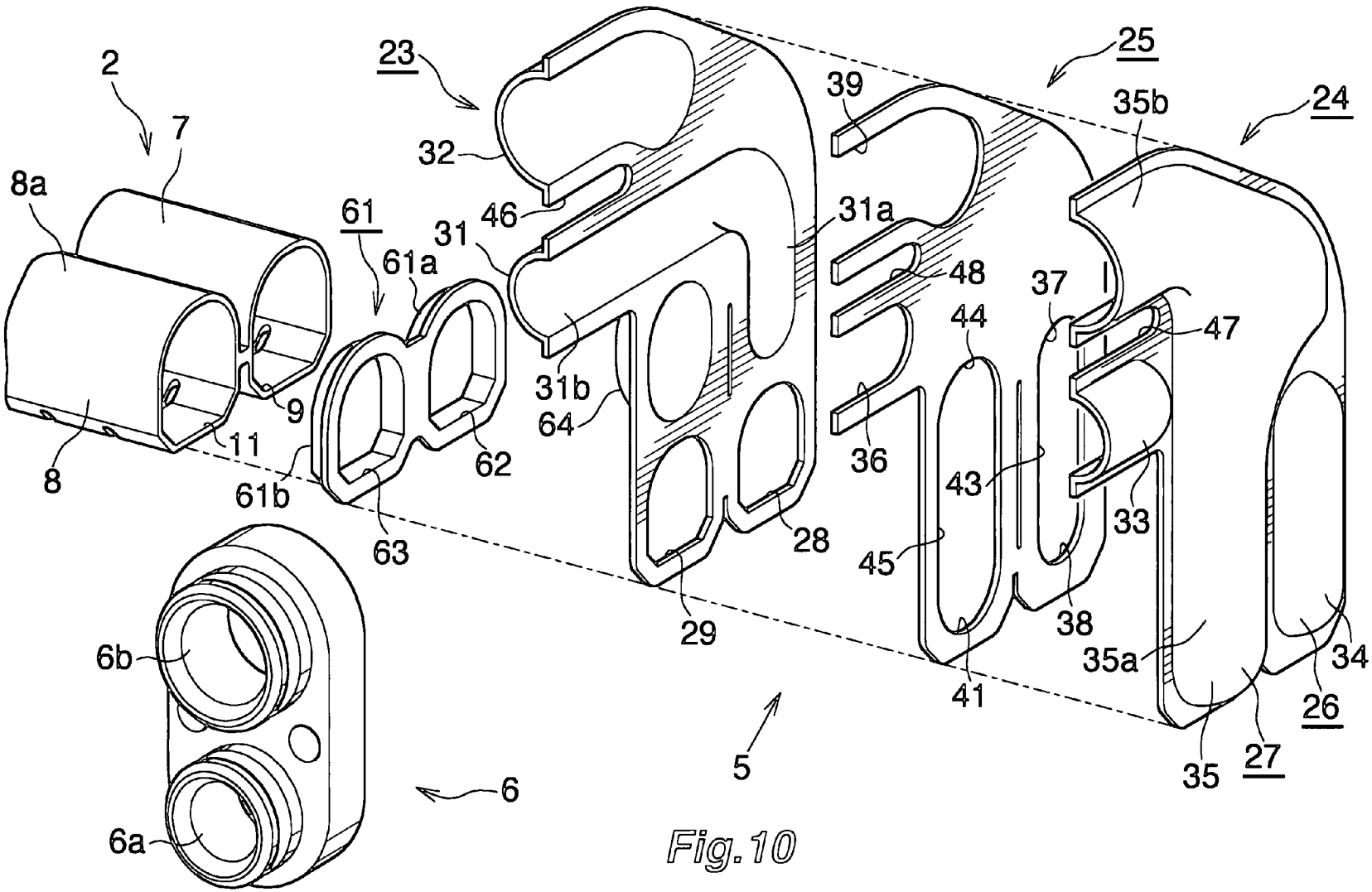
FIG. 10 is a partial enlarged and exploded perspective view of the refrigerant inlet-outlet member of the evaporator according to the second embodiment of the present invention.

FIGS. 8 to 10 show a second embodiment of the evaporator according to the present invention.

In the case of an evaporator 60 shown in FIGS. 8 to 10, no cutout is formed in the right end portion of the top wall 8*a* of the refrigerant outlet header section 8 of the first header tank 2. An end member 61 formed of aluminum is joined to the right end of the first header tank 2 such that the end member 61 extends over the refrigerant inlet header section 7 and the refrigerant outlet header section 8. The end member 61 has a first opening 62 which communicates with the refrigerant inlet 9 of the refrigerant inlet header section 7 and a second opening 63 which communicates with the refrigerant outlet 11 of the refrigerant outlet header section 8. A leftward projecting portion 61*a* is integrally formed around the first opening 62 of the end member 61 such that the leftward projecting portion 61*a* extends along the entire circumference of the first opening 62. The leftward projecting portion 61*a* is inserted into the refrigerant inlet header section 7 through the refrigerant inlet 9. A leftward projecting portion 61*b* is integrally formed around the second opening 63 of the end member 61 such that the leftward projecting portion 61*b* extends along the entire circumference of the second opening 63. The leftward projecting portion 61*b* is inserted into the refrigerant outlet header section 8 through the refrigerant outlet 11.

Leftward projecting portions are not formed around the communication openings 28 and 29 of the first plate 23 of the refrigerant inlet-outlet member 5. Further, the first plate 23 of the refrigerant inlet-outlet member 5 has a vertical third outflow-channel-forming outwardly swelled portion 64 formed in such a manner that its lower end portion is located at a position separated slightly upward from the second communication opening 29, and its upper end is located at a vertical position slightly below the horizontal portion 31*b* of the first inflow-channel-forming outwardly swelled portion 31. The fourth through hole 44 of the intermediate plate 25 establishes communication between the third outflow-channel-forming outwardly swelled portion 64 of the first plate 23 and the second outflow-channel-forming outwardly swelled portion 35 of the second plate 24.

The structure of the remaining portion is the same as that of the evaporator shown in FIGS. 1 to 7, and identical members and identical portions are denoted by the same reference numerals.

Notably, the present invention can be applied to an evaporator which includes a refrigerant inlet header section and a refrigerant outlet header section juxtaposed in the front-rear direction, and a refrigerant circulation path for establishing communication between the two header sections, wherein the refrigerant circulation path is formed by a plurality of intermediate header sections and a plurality of heat exchange tubes; at least one heat exchange tube group composed of a plurality of heat exchange tubes disposed at predetermined intervals is disposed between the refrigerant inlet header section and an intermediate header section which face each other, between the refrigerant outlet header section and another intermediate header section which face each other, and between intermediate header sections which face each other; opposite end portions of the heat exchange tubes of each heat exchange tube group are connected to the corresponding header sections which face each other; a refrigerant inlet is formed at one end of the refrigerant inlet header section, and a refrigerant outlet is formed at one end of the refrigerant outlet header section, the one end being located on the same side as the refrigerant inlet; and refrigerant having flowed into the refrigerant inlet header section through the refrigerant inlet passes through the refrigerant circulation path, and reaches the refrigerant outlet header section, from which the refrigerant is fed out through the refrigerant outlet.

Further, the present invention can be applied to a so-called laminated-type evaporator in which a plurality of flat hollow bodies each composed of a pair of dish-shaped plates which faces each other and are brazed together along the circumferential edges thereof are disposed in parallel, which has a refrigerant inlet header section and a refrigerant outlet header section juxtaposed in the front-rear direction, a refrigerant turn section disposed apart from the two header sections, a plurality of go-side refrigerant flow channels for establishing communication between the refrigerant inlet header section and the refrigerant turn section, a plurality of return-side refrigerant flow channels for establishing communication between the refrigerant out header section and the refrigerant turn section, and in which a refrigerant inlet is formed at one end of the refrigerant inlet header section, and a refrigerant outlet is formed at one end of the refrigerant outlet header section, the one end being located on the same side as the refrigerant inlet, wherein refrigerant having flowed into the refrigerant inlet header section through the refrigerant inlet passes through the go-side refrigerant flow channels, reaches the refrigerant turn section, changes its flow direction there, passes through the return-side refrigerant flow channels, and returns to the refrigerant outlet header section, from which the refrigerant is fed out through the refrigerant outlet.

What is claimed is:

1. An evaporator comprising a refrigerant inlet header section and a refrigerant outlet header section juxtaposed in a front-rear direction, and a refrigerant circulation path for establishing communication between the two header sections, wherein a refrigerant inlet is formed at one end of the refrigerant inlet header section, and a refrigerant outlet is formed at one end of the refrigerant outlet header section, the one end being located on the same side as the refrigerant inlet; and refrigerant having flowed into the refrigerant inlet header section through the refrigerant inlet passes through the refrigerant circulation path, and reaches the refrigerant outlet header section, from which the refrigerant is fed out through the refrigerant outlet, wherein a refrigerant inlet-outlet member formed by stacking and joining a first plate, a second plate, and an intermediate plate located between the first plate and the second plate is joined to the refrigerant inlet header section and the refrigerant outlet header section such that the refrigerant inlet-outlet member extends over the refrigerant inlet header section and the refrigerant outlet header section;

the refrigerant inlet-outlet member has an inflow channel and an outflow channel provided such that the inflow channel and the outflow channel cross each other as viewed from a side, one end of the inflow channel communicating with the refrigerant inlet of the refrigerant inlet header section, the other end of the inflow channel being opened to a rear edge of the refrigerant inlet-outlet member, one end of the outflow channel communicating with the refrigerant outlet of the refrigerant outlet header section, and the other end of the outflow channel being opened to the rear edge of the refrigerant inlet-outlet member; and at least one of the first and second plates has an inflow-channel-forming outward swelled portion, and the other of the first and second plates has an outflow-channel-forming outward swelled portion.

2. An evaporator according to claim 1, wherein the inflow-channel-forming outward swelled portion and the outflow-channel-forming outward swelled portion are formed on each of the first and second plates of the refrigerant inlet-outlet member; and, in order to enable the inflow channel and the outflow channel to cross each other as viewed from the side, cutouts and a through hole are formed in the intermediate plate such that communication is established between the inflow-channel-forming outward swelled portions of the first and second plates and communication is established between the outflow-channel-forming outward swelled portions of the first and second plates.

3. An evaporator according to claim 1, wherein the first plate of the refrigerant inlet-outlet member has a first communication opening communicating with the refrigerant inlet of the refrigerant inlet header section, a second communication opening communicating with the refrigerant outlet of the refrigerant outlet header section, a first inflow-channel-forming outwardly swelled portion whose one end is located at a position separated from the first and second communication openings and whose other end is opened to the rear edge of the first plate, and a first outflow-channel-forming outwardly swelled portion whose one end is located at a position separated from the first and second communication openings and whose other end is opened to the rear edge of the first plate; the second plate has a second inflow-channel-forming outwardly swelled portion whose one end is located at a position separated from the first and second communication openings of the first plate and whose other end is opened to the rear edge of the second plate at the same position as the other end of the first inflow-channel-forming outwardly swelled portion of the first plate, a third inflow-channel-forming outwardly swelled portion whose one end is located at a position corresponding to the first communication opening of the first plate and whose other end is located at a position separated from the second communication opening of the first plate and the second inflow-channel-forming outwardly swelled portion, and a second outflow-channel-forming outwardly swelled portion whose one end is located at a position corresponding to the second communication opening of the first plate and whose other end is opened to the rear edge of the second plate at the same position as the first outflow-channel-forming outwardly swelled portion of the first plate; and the intermediate plate has a first cutout whose one end is opened to the rear edge of the intermediate plate at the same position as the first inflow-channel-forming outwardly swelled portion of the first plate and which establishes communication between the interior of the first inflow-channel-forming outwardly swelled portion of the first plate and the interior of the second inflow-channel-forming outwardly swelled portion of the second plate, a first through hole which establishes communication between the interior of the first inflow-channel-forming outwardly swelled portion of the first plate and the interior of the third inflow-channel-forming outwardly swelled portion of the second plate, a second through hole which establishes communication between the first communication opening of the first plate and the interior of the third inflow-channel-forming outwardly swelled portion of the second plate, a second cutout whose one end is opened to the rear edge of the intermediate plate at the same position as the first outflow-channel-forming outwardly swelled portion of the first plate and which establishes communication between the interior of the first outflow-channel-forming outwardly swelled portion of the first plate and the interior of the second outflow-channel-forming outwardly swelled portion of the second plate, and a third through hole which establishes communication between the second communication opening of the first plate and the interior of the second outflow-channel-forming outwardly swelled portion of the second plate.

4. An evaporator according to claim 3, wherein a portion of the intermediate plate between the first through hole and the second through hole is cut and removed so as to form a removed region so that the first through hole and the second through hole communicate with each other via the removed region, whereby the first through hole and the second through hole are unified with each other.

5. An evaporator according to claim 1, wherein the first plate has a third outflow-channel-forming outwardly swelled portion formed independently of the first communication opening, the first inflow-channel-forming outwardly swelled portion, and the first outflow-channel-forming outwardly swelled portion; and the intermediate plate has a fourth through hole which establishes communication between the interior of the third outflow-channel-forming outwardly swelled portion and the interior of the second outflow-channel-forming outwardly swelled portion of the second plate.

6. An evaporator according to claim 5, wherein a portion of the intermediate plate between the third through hole and the fourth through hole is cut and removed so as to form a removed region so that the third through hole and the fourth through hole communicate with each other via the removed region, whereby the third through hole and the fourth through hole are unified with each other.

7. An evaporator according to claim 1, wherein the rear-edge-side opening of the outflow channel of the refrigerant inlet-outlet member is located above the rear-edge-side opening of the inflow channel of the refrigerant inlet-outlet member.

* * * * *